US012630767B2

(12) United States Patent
Patel et al.

(10) Patent No.: US 12,630,767 B2
(45) Date of Patent: May 19, 2026

(54) CO-PROCESSING OF WASTE PLASTIC IN COKERS

(71) Applicant: ExxonMobil Chemical Patents Inc., Baytown, TX (US)

(72) Inventors: Bryan A. Patel, Jersey City, NJ (US); Randolph J. Smiley, Hellertown, PA (US); Lawrence R. Gros, Katy, TX (US); Mohsen N. Harandi, New Hope, PA (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 169 days.

(21) Appl. No.: 17/772,007

(22) PCT Filed: Oct. 27, 2020

(86) PCT No.: PCT/US2020/057478

§ 371 (c)(1),
(2) Date: Apr. 26, 2022

(87) PCT Pub. No.: WO2021/091724

PCT Pub. Date: May 14, 2021

(65) Prior Publication Data

US 2022/0372375 A1 Nov. 24, 2022

Related U.S. Application Data

(60) Provisional application No. 62/930,844, filed on Nov. 5, 2019.

(51) Int. Cl.
*C10G 1/10* (2006.01)
*C10B 49/10* (2006.01)
(Continued)

(52) U.S. Cl.
CPC ..... *C10G 1/10* (2013.01); *C10B 49/10* (2013.01); *C10B 53/07* (2013.01); *C10B 55/10* (2013.01);
(Continued)

(58) Field of Classification Search
None
See application file for complete search history.

(56) References Cited

U.S. PATENT DOCUMENTS 3,661,543 A * 5/1972 Saxton ..... C10J 3/84 201/31
4,118,281 A 10/1978 Yan
(Continued)

FOREIGN PATENT DOCUMENTS

| | | |
|---|---|---|
| CN | 1837331 | 9/2006 |
| CN | 101230284 B | 6/2013 |
| JP | H0680970 A | 3/1994 |
| WO | WO9514069 A1 | 5/1995 |

OTHER PUBLICATIONS

Machine translation CN 1837331. Obtained Jan. 10, 2024 (Year: 2024).*

(Continued)

*Primary Examiner* — In Suk C Bullock
*Assistant Examiner* — Alyssa L Cepluch
(74) *Attorney, Agent, or Firm* — C. Tumey Law Group PLLC

(57) ABSTRACT

Systems and methods are provided for co-processing of plastic waste in a coking environment or other thermal conversion environment. The co-processing of plastic waste in a coking environment can be performed by performing four types of processes on the plastic waste. The plastic waste can be conditioned by classifying and sizing of the plastic waste to improve the suitability of the plastic waste for co-processing. The conditioned plastic waste particles
(Continued)

can be entrained and/or dissolved into a solvent and/or the base feed. The solution and/or slurry of plastic waste can be passed into a coking environment, such as a fluidized coking environment or a delayed coking environment. The plastic waste can then be co-processed in the coking environment to generate liquid product.

12 Claims, 3 Drawing Sheets

(51) Int. Cl.
*C10B 53/07* (2006.01)
*C10B 55/10* (2006.01)
*C10G 1/00* (2006.01)

(52) U.S. Cl.
CPC ..... *C10G 1/002* (2013.01); *C10G 2300/1003* (2013.01); *C10G 2300/30* (2013.01); *C10G 2400/06* (2013.01)

(56) References Cited

U.S. PATENT DOCUMENTS

| | | | | |
|---|---|---|---|---|
| 4,851,601 | A | 7/1989 | Fukuda et al. | |
| 5,340,464 | A | 8/1994 | Mickas | |
| 5,445,659 | A * | 8/1995 | Khan | C10G 1/10 48/209 |
| 5,705,724 | A | 1/1998 | Collins et al. | |
| 2018/0245001 | A1* | 8/2018 | Humphreys | C10G 31/10 |
| 2019/0270939 | A1* | 9/2019 | Javeed | C10G 1/002 |

OTHER PUBLICATIONS

Nchare, M, Benxian, S, and Anagho, S, "Co-processing Vacuum Residue with Waste Plastics in a Delayed Coking Process: Kinetics and Modeling," China Petroleum and Petrochemical Technology, 2012 (14): 44-19.

* cited by examiner

Background Art

Background Art

CO-PROCESSING OF WASTE PLASTIC IN COKERS

CROSS-REFERENCE TO RELATED APPLICATIONS

This application is a National Phase application claiming priority to PCT application Serial No. PCT/US2020/057478, filed Oct. 27, 2020, which claims the priority benefit of U.S. Ser. No. 62/930,844, filed Nov. 5, 2019, which are incorporated by reference in their entirety.

FIELD

Systems and methods are provided for co-processing of waste plastic in cokers.

BACKGROUND

Processing of plastic waste is a subject of increasing importance. It would be desirable to have a processing pathway that allowed for conversion of plastic waste into liquid products. The liquid products can potentially be used as fuels, lubes and/or as a feedstock for production of olefin monomers. Although dedicated processing systems could be used for plastic waste conversion, such dedicated systems require substantial initial capital costs and a constant supply of waste plastic feed. Thus, it would be desirable to leverage an existing processing unit to be able to co-process plastic waste.

Another difficulty with conversion of plastic waste is that the properties of plastic waste can vary widely. Thus, it would be desirable to have a processing system and method that can tolerate variability in the plastic waste feed.

Chinese patent CN 101230284 B describes a method for incorporating plastic waste into the feed to a delayed coker. The plastic waste is pulverized and then heated into an extrudable state. The extrudable plastic is then maintained at an intermediate temperature of 290° C. to 320° C. until it is time for processing. The extrudable plastic is then heated (optionally along with other coker feedstock) to the desired coking temperature and passed into a delayed coker.

Chinese patent application CN 1837331 describes a method for co-processing of plastic waste with a residual feed in a delayed coker. The residual feed is heated to a temperature of 250° C. to 280° C. Plastic waste particles are mixed with the heated residual feed. The amount of plastic waste particles corresponds to 10 wt % to 15 wt % of the mixture. The mixture of residual feed and plastic waste is then passed into a coker tower where the mixture is further heated to the coker tower temperature of 480° C. to 500° C.

SUMMARY

In various aspects, a method for performing fluidized coking on a combined feed is provided. The method includes physically processing a plastic waste feedstock comprising one or more polymers to form a processed plastic waste feedstock comprising a median particle size of 5 mm or less. The method further includes combining at least a portion of the processed plastic waste feedstock with a feedstock comprising a T10 distillation point of 343° C. or higher to form a combined feed comprising 1.0 wt % to 25 wt % of the plastic waste feedstock. The method further includes exposing at least a portion of the combined feed to fluidized coking conditions in a coking reactor to form a coker effluent.

In another aspect, a system for performing fluidized coking is provided. The system includes a physical processing stage for forming a processed plastic waste feedstock. The system further includes a mixing stage in fluid communication with the physical processing stage and further in fluid communication with a source of a second feedstock, the mixing stage further comprising a heater. The system further includes a fluidized coking stage in fluid communication with the mixing stage, the fluidized coking stage comprising a reactor and a gasifier.

DETAILED DESCRIPTION

Figure 1:
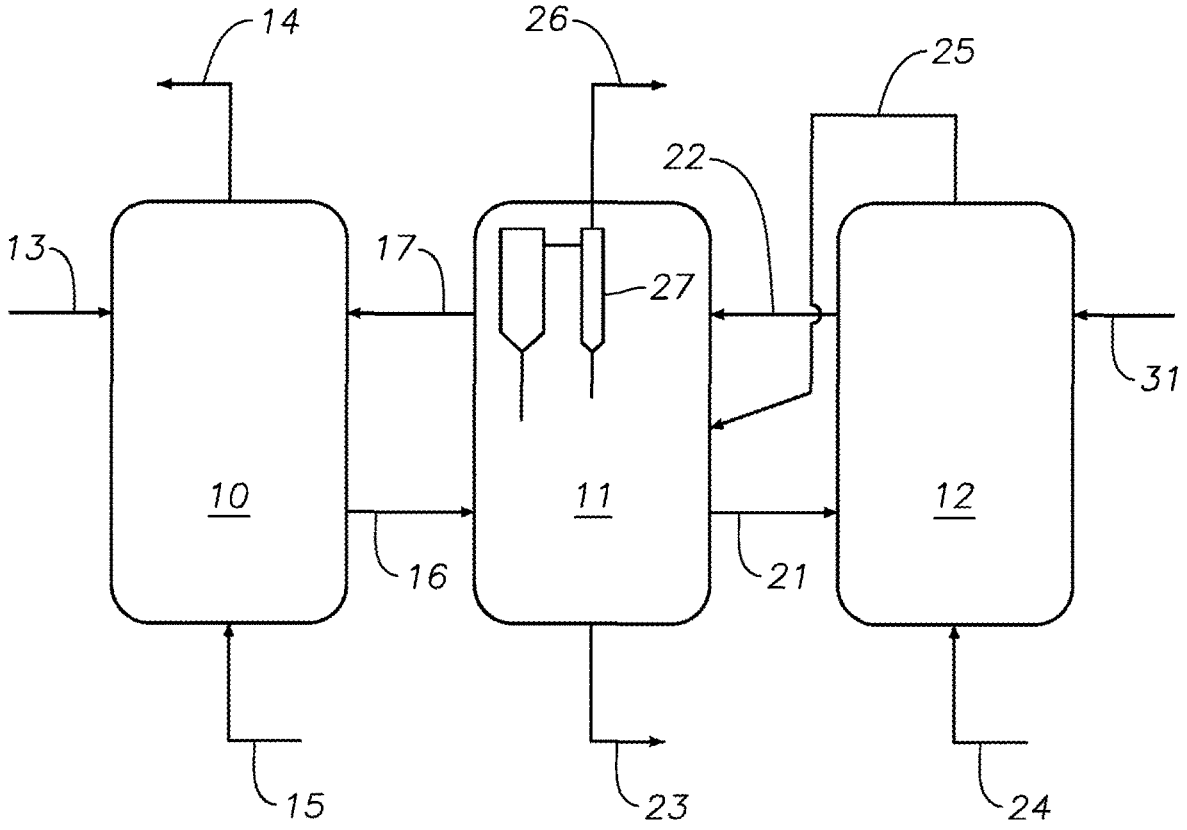
FIG. 1 shows an example of a fluidized bed coking system including a coker, a heater, and a gasifier.

All numerical values within the detailed description and the claims herein are modified by "about" or "approximately" the indicated value, and take into account experimental error and variations that would be expected by a person having ordinary skill in the art.

In various aspects, systems and methods are provided for co-processing of plastic waste in a coking environment, visbreaking environment, or another thermal conversion environment. In some aspects, the plastic waste can be incorporated into the feed for a fluidized coking environment, such as a Flexicoking™ reaction environment. In other aspects, the plastic waste can be incorporated into the feed for a delayed coking environment.

Coking can provide a flexible reaction system for co-processing of plastic waste. Even though the type of polymers in plastic waste can vary widely, coking can be performed to generate a liquid product slate. In aspects where Flexicoking™ is used for coking, synthesis gas can also be generated while reducing or minimizing net coke yield when co-processing a conventional coker feed with plastic waste.

The co-processing of plastic waste in a coking environment (or other thermal conversion environment) can be performed by performing four types of processes on the plastic waste. First, the plastic waste can be conditioned by classifying and sizing of the plastic waste to improve the suitability of the plastic waste for co-processing. Second, the conditioned plastic waste particles can be entrained and/or dissolved into a solvent and/or the base feed. In aspects where a solvent is used, the solvent can preferably correspond to a refinery stream, such as a refinery stream formed by the co-processing of the plastic waste in the coking environment. Optionally, in aspects where the plastic waste feed is mixed with a solvent and/or base feed, a stripping gas can be added to remove HCl or other gases that may evolve as the plastic waste is heated. Third, the solution and/or slurry of plastic waste can be passed into a coking environment, such as a fluidized coking environment or a delayed coking environment. The solution and/or slurry of plastic waste can be introduced as a separate stream, or the solution and/or slurry can be mixed with a conventional coker feedstock prior to entering the coking environment. Fourth, the plastic waste can then be co-processed in the coking environment to generate liquid products.

In some aspects, co-processing of plastic waste in a coking environment can provide advantages relative to coking of a conventional feed. Conventional coker feeds are often selected for coking based on having a relatively low molar ratio of hydrogen atoms to carbon atoms in the feed. In comparison with such a conventional coker feed, many types of plastic waste include a higher molar ratio of hydrogen atoms to carbon atoms. This additional hydrogen content in plastic waste can reduce the amount of coke that is formed in favor of increased production of liquid products.

In some aspects, a plastic waste feedstock can be co-processed with a coker feedstock in a fluidized coking environment, such as a Flexicoking™ coking environment. By sufficiently reducing or minimizing the particle size of the particles in a plastic waste feedstock, the plastic waste can be unexpectedly incorporated into a fluidized coking environment. Further additional benefits can be realized in a Flexicoking environment, where plastic waste can be co-processed while increasing the amount of production of synthesis gas.

In this discussion, a reference to a "$C_x$" fraction, stream, portion, feed, or other quantity is defined as a fraction (or other quantity) where 50 wt % or more of the fraction corresponds to hydrocarbons having "x" number of carbons. When a range is specified, such as "$C_x$-$C_y$", 50 wt % or more of the fraction corresponds to hydrocarbons having a number of carbons between "x" and "y". A specification of "$C_{x+}$" (or "$C_{x-}$") corresponds to a fraction where 50 wt % or more of the fraction corresponds to hydrocarbons having the specified number of carbons or more (or the specified number of carbons or less).

In this discussion, the naphtha boiling range is defined as roughly the boiling point of a $C_5$ alkane (roughly 30° C.) to 177° C. The distillate boiling range is defined as 177° C. to 343° C. The gas oil boiling range is defined as 343° C. to 566° C. The vacuum resid boiling range corresponds to temperatures greater than 566° C.

Feedstock

In various aspects, coking can be used to co-process a feed corresponding to a mixture of a conventional coker feedstock and a plastic waste feedstock. The conventional coker feedstock can correspond to one or more types of petroleum and/or renewable feeds with a suitable boiling range for processing in a coker. The plastic waste can correspond to one or more types of polymers, such as a plurality of polymers, along with other components typically used in formulation of polymers. The amount of plastic waste in the feed can correspond to 1.0 wt % to 25 wt % of the total feed to the coker, or 3.0 wt % to 25 wt %, or 10 wt % to 25 wt %, or 3.0 wt % to 15 wt %. Optionally, a solvent can also be included in the plastic waste feedstock to assist with introducing the plastic waste into the coking environment. The combined amount of plastic waste and solvent in the feed can correspond to 1.0 wt % to 30 wt % of the total feed to the coker, or 3.0 wt % to 30 wt %, or 10 wt % to 30 wt %, or 3.0 wt % to 15 wt %. The conventional coker feedstock can correspond to 70 wt % to 99 wt % of the total feed to the coker.

In some aspects, the coker feedstock for co-processing with the plastic waste feedstock can correspond to a relatively high boiling fraction, such as a heavy oil feed. For example, the coker feedstock portion of the feed can have a T10 distillation point of 343° C. or more, or 371° C. or more. Examples of suitable heavy oils for inclusion in the coker feedstock include, but are not limited to, reduced petroleum crude; petroleum atmospheric distillation bottoms; petroleum vacuum distillation bottoms, or residuum; pitch; asphalt; bitumen; other heavy hydrocarbon residues; tar sand oil; shale oil; or even a coal slurry or coal liquefaction product such as coal liquefaction bottoms. Such feeds will typically have a Conradson Carbon Residue (ASTM D189-165) of at least 5 wt %, generally from 5 to 50 wt %. In some preferred aspects, the feed is a petroleum vacuum residuum.

Some examples of conventional petroleum chargestock suitable for processing in a delayed coker or fluidized bed coker can have a composition and properties within the ranges set forth below in Table 1.

TABLE 1

| Example of Coker Feedstock | | |
|---|---|---|
| Conradson Carbon | 5 to 40 | wt % |
| API Gravity | −10 to 35° | |
| Boiling Point | 340° C.+ to 650° C.+ | |
| Sulfur | 1.5 to 8 | wt % |
| Hydrogen | 9 to 11 | wt % |
| Nitrogen | 0.2 to 2 | wt % |
| Carbon | 80 to 86 | wt % |
| Metals | 1 to 2000 | wppm |

In addition to petroleum chargestocks, renewable feedstocks derived from biomass having a suitable boiling range can also be used as part of the coker feed. Such renewable feedstocks include feedstocks with a T10 boiling point of 340° C. or more and a T90 boiling point of 600° C. or less. An example of a suitable renewable feedstock derived from biomass can be a pyrolysis oil feedstock derived at least in part from biomass.

When integrating a plastic waste feedstock as part of a total feed for a coking process, the plastic waste feedstock can include one or more types of polymers. Examples of common polymer types include, but are not limited to, polyolefins (such as polyethylene and polypropylene), polyesters, polyethylene terephthalate, polyvinyl chloride and/or polyvinylidene chloride, polyamide (e.g., nylon), ethylene vinyl acetate and polystyrene. Still other polyolefins can correspond to polymers (including co-polymers) of butadiene, isoprene, and isobutylene. These common polymer types can have widely differing physical properties, in addition to having different molar hydrogen to carbon ratios and heteroatom contents (atoms other than carbon and hydrogen). Attempting to process such a highly variable feedstock in many types of conventional processes could require substantial changes in processing conditions to compensate for variations in the feed. However, by co-processing plastic waste with a conventional coker feedstock, coking can be performed with reduced or minimized variations in coker operating conditions due to changes in feed composition.

In some aspects, at least a portion of the polymers in the plastic waste feed (such as a majority of the polymers) can correspond to polyolefins. In such aspects, the amount of polyolefins in the plastic waste feed, relative to the weight of the plastic waste feed, can correspond to 1.0 wt % to 100 wt % of the plastic waste feed, or 1.0 wt % to 90 wt %, or 1.0 wt % to 50 wt %, or 10 wt % to 100 wt %, or 10 wt % to 90 wt %, or 10 wt % to 50 wt %, or 40 wt % to 100 wt %, or 40 wt % to 90 wt %, or 50 wt % to 100 wt %, or 50 wt % to 90 wt %.

In some aspects, polyvinyl chloride and/or polyvinylidene chloride can be included in the plastic waste feed. In such aspects, the polyvinyl chloride and/or polyvinylidene chloride can correspond to any convenient amount of the plastic waste feed, such as 0.1 wt % to 100 wt %, or 0.1 wt % to 50 wt %, or 0.1 wt % to 20 wt %, or 1.0 wt % to 75 wt %, or 1.0 wt % to 50 wt %, or 1.0 wt % to 20 wt %, or 10 wt % to 100 wt %, or 10 wt % to 50 wt %.

In addition to polymers, a plastic waste feedstock can include a variety of other components. Such other components can include additives, modifiers, packaging dyes, and/or other components typically added to a polymer during and/or after formulation. The feedstock can further include any components typically found in plastic waste. Finally, the feedstock can further include one or more solvents or carriers so that the feedstock to the coking process corresponds to a solution or slurry of the plastic waste.

In this discussion, unless otherwise specified, weights of plastic in a feed/feedstock correspond to weights relative to the total plastic content in the feed/feedstock. Any additives/modifiers/other components included in a formulated polymer are included in this weight. However, unless otherwise specified, the weight percentages described herein exclude any solvents or carriers used.

In various aspects, the plastic waste can be prepared for mixing with the coker feedstock and/or delivery into the coker reactor. Methods for preparing the plastic waste can include reducing the particle size of the polymers and mixing the polymers with a solvent or carrier. Another option can be to melt the plastic waste and then extrude and/or pump it to mix it with a solvent or carrier.

In aspects where the plastic waste is introduced into the coking reactor at least partially as solids, having a small particle size can facilitate transport of the solids and/or reduce the likelihood of incomplete conversion. To prepare solid plastic waste for a coking environment, a physical processing step can be performed. Examples of physical processing can include crushing, chopping, shredding, pelletizing (optionally after melting), and grinding (including cryogenic grinding). In some aspects, the physical processing can be used to reduce the median particle size to 0.01 mm to 5.0 mm, or 0.1 mm to 5.0 mm, or 0.01 mm to 3.0 mm, or 0.1 mm to 3.0 mm, or 0.01 mm to 3.0 mm, or 0.1 mm to 3.0 mm, or 1.0 mm to 5.0 mm, or 1.0 mm to 3.0 mm. to reduce the maximum particle size. For determining a median particle size, the particle size is defined as the diameter of the smallest bounding sphere that contains the particle. Optionally, after the physical processing, the plastic waste can be sieved or filtered to remove larger particles. Additionally or alternately, the plastic waste can be melted and pelletized to improve the uniformity of the particle size of the plastic particles. In some aspects, the sieving or filtering can be used to reduce the maximum particle size to 10 mm or less, or 5.0 mm or less.

Additionally or alternately, a solvent can be added to the feedstock. For introduction into a coking environment, it can be convenient for the plastic waste to be in the form of a solution, slurry, or other fluid-type phase. If a solvent is used to at least partially solvate the plastic waste, any convenient solvent can be used. Examples of suitable solvents can include (but are not limited to) a wide range of petroleum or petrochemical products. For example, some suitable solvents include crude oil, naphtha, kerosene, diesel, light or heavy cycle oils, catalytic slurry oil, and gas-oils. Other potential solvents can correspond to naphthenic and/or aromatics solvents, such as toluene, benzene, methylnaphthalene, cyclohexane, methylcyclohexane, and mineral oil. Still other solvents can correspond to refinery fractions, such as a gas oil fraction or naphtha fraction from a coker. As yet another example, a distillate and/or gas oil boiling range fraction can be used that generated by coking of the combined feed (i.e., combined plastic waste feedstock and coker feedstock).

Mixing and Pre-Heating of Feedstocks

In some preferred aspects, the plastic waste feedstock and the coker feedstock can be mixed to form a combined feed prior to entering the coking environment. More generally, however, any convenient method for introducing both the plastic waste feedstock and the coker feedstock into the coking environment can be used.

In aspects where the coker feedstock and the plastic waste feedstock are mixed to form a combined feed prior to entering the coking environment, mixing the feedstocks can be beneficial for assisting with heating of the plastic waste feedstock. Plastic has relatively poor heat transfer properties. By mixing the plastic waste feedstock with the coker feedstock, the smaller portion of plastic waste feedstock can be distributed in the larger portion of coker feedstock. This dispersal of the plastic waste feedstock in the petroleum/biomass portion of the feedstock can increase the surface area for transferring heat, thereby increasing the speed of the heat transfer.

Prior to being introduced into the coking environment, the feedstocks (optionally in the form of a combined feed) are pre-heated. Pre-heating the feedstocks in one or more heating stages can increase the temperature of the feedstocks to a mixing and storage temperature, to a temperature related to the coking temperature, or to another convenient temperature.

In some aspects, a portion of the pre-heating of a plastic waste feedstock can be performed by mixing the plastic waste feedstock with a coker feedstock in a mixing tank and heating the mixture in the mixing tank. For example, a plastic waste feedstock and a coker feedstock can be mixed in a heated stirred tank for storage operating at 200° C. to 325° C., or 275° C. to 325° C. Tank agitation aids in uniform dispersal of waste plastic into resid and maintains slurry suspension. Heating in a mixing tank provides heat to the combined feed prior to introducing the combined feed into the coking reaction environment. This can reduce or minimize additional coker heat duty that would otherwise be required to heat the plastic waste feedstock to thermal cracking temperatures. In addition to heating, stripping of the combined plastic waste feedstock and coker feedstock using a stripping gas can be performed in a mixing tank. Passing a stripping gas through the combined feed can assist with removing HCl that may be entrained in the combined feed. Such HCl can be created, for example, by exposing chlorine-containing polymers to heat. More generally, stripping can remove other gases that may be entrained in the combined feed.

Another option can be to melt the plastic in an extruder. After extruding the melted plastic, the plastic can either be directly mixed with the feed and/or a solvent, or the extruded plastic can be pelletized to form a desired particle size for the plastic.

Still another option can be to mix the plastic waste feedstock with the coker feedstock after the pre-heater furnace for the coker. In this type of aspect, the coker feedstock can be heated to a higher temperature in the pre-heater, and then the plastic waste feedstock can be added to the pre-heated coker feedstock to heat the plastic waste.

Coking Conditions—Fluidized Coking

Coking processes in modern refinery settings can typically be categorized as delayed coking or fluidized bed coking. Fluidized bed coking is a petroleum refining process in which heavy petroleum feeds, typically the non-distillable residues (resids) from the fractionation of heavy oils are converted to lighter, more useful products by thermal decomposition (coking) at elevated reaction temperatures, typically 480° C. to 590° C., (~900° F. to 1,100° F.) and in most cases from 500° C. to 550° C. (~930° F. to 1,020° F.). Heavy oils which may be processed by the fluid coking process include heavy atmospheric resids, petroleum vacuum distillation bottoms, aromatic extracts, asphalts, and bitumens from tar sands, tar pits and pitch lakes of Canada (Athabasca, Alta.), Trinidad, Southern California (La Brea (Los Angeles), McKittrick (Bakersfield, Calif.), Carpinteria (Santa Barbara County, Calif.), Lake Bermudez (Venezuela) and similar deposits such as those found in Texas, Peru, Iran, Russia and Poland.

The Flexicoking™ process, developed by Exxon Research and Engineering Company, is a variant of the fluid coking process that is operated in a unit including a reactor and a heater, but also including a gasifier for gasifying the coke product by reaction with an air/steam mixture to form a low heating value fuel gas. A stream of coke passes from the heater to the gasifier where all but a small fraction of the coke is gasified to a low-BTU gas (~120 BTU/standard cubic feet) by the addition of steam and air in a fluidized bed in an oxygen-deficient environment to form fuel gas comprising carbon monoxide and hydrogen. In a conventional Flexicoking™ configuration, the fuel gas product from the gasifier, containing entrained coke particles, is returned to the heater to provide most of the heat required for thermal cracking in the reactor with the balance of the reactor heat requirement supplied by combustion in the heater. A small amount of net coke (about 1 percent of feed) is withdrawn from the heater to purge the system of metals and ash. The liquid yield and properties are comparable to those from fluid coking. The fuel gas product is withdrawn from the heater following separation in internal cyclones which return coke particles through their diplegs.

Figure 2:
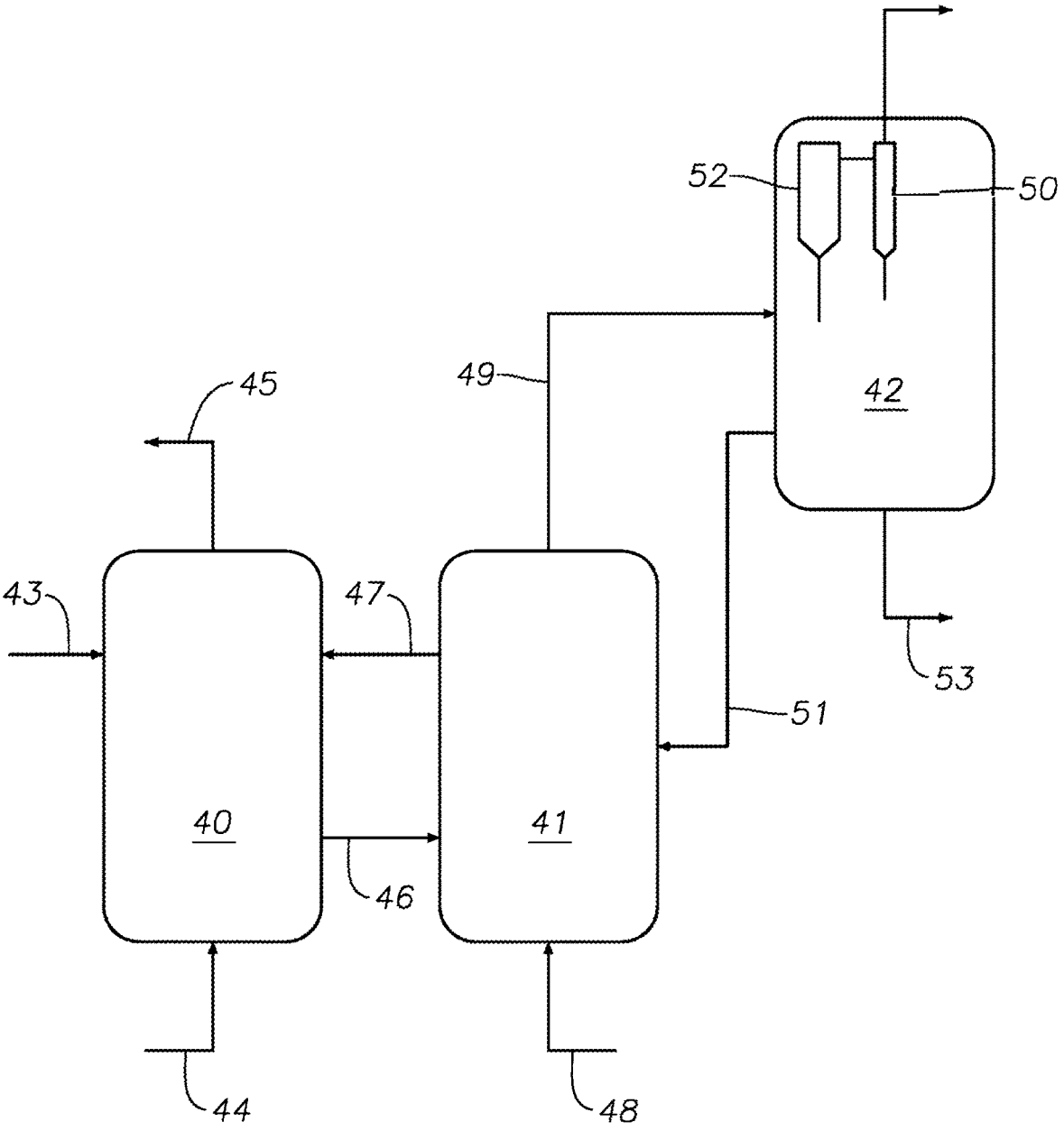
FIG. 2 shows an example of a fluidized bed coking system including a coker and a gasifier.

In this description, the term "Flexicoking" (trademark of ExxonMobil Research and Engineering Company) is used to designate a fluid coking process in which heavy petroleum feeds are subjected to thermal cracking in a fluidized bed of heated solid particles to produce hydrocarbons of lower molecular weight and boiling point along with coke as a by-product which is deposited on the solid particles in the fluidized bed. The resulting coke can then converted to a fuel gas by contact at elevated temperature with steam and an oxygen-containing gas in a gasification reactor (gasifier). This type of configuration can more generally be referred to as an integration of fluidized bed coking with gasification. FIGS. 1 and 2 provide examples of fluidized coking reactors that include a gasifier.

FIG. 1 shows an example of a Flexicoker unit (i.e., a system including a gasifier that is thermally integrated with a fluidized bed coker) with three reaction vessels: reactor, heater and gasifier. The unit comprises reactor section 10 with the coking zone and its associated stripping and scrubbing sections (not separately indicated), heater section 11 and gasifier section 12. The relationship of the coking zone, scrubbing zone and stripping zone in the reactor section is shown, for example, in U.S. Pat. No. 5,472,596, to which reference is made for a description of the Flexicoking unit and its reactor section. A heavy oil feed is introduced into the unit by line 13 and cracked hydrocarbon product withdrawn through line 14. Fluidizing and stripping steam is supplied by line 15. Cold coke is taken out from the stripping section at the base of reactor 10 by means of line 16 and passed to heater 11. The term "cold" as applied to the temperature of the withdrawn coke is, of course, decidedly relative since it is well above ambient at the operating temperature of the stripping section. Hot coke is circulated from heater 11 to reactor 10 through line 17. Coke from heater 11 is transferred to gasifier 12 through line 21 and hot, partly gasified particles of coke are circulated from the gasifier back to the heater through line 22. The excess coke is withdrawn from the heater 11 by way of line 23. In conventional configurations, gasifier 12 is provided with its supply of steam and air by line 24 and hot fuel gas is taken from the gasifier to the heater though line 25. In some alternative aspects, instead of supplying air via a line 24 to the gasifier 12, a stream of oxygen with 95 vol % purity or more can be provided, such as an oxygen stream from an air separation unit. In such aspects, in addition to supplying a stream of oxygen, a stream of an additional diluent gas can be supplied by line 31. The additional diluent gas can correspond to, for example, $CO_2$ separated from the fuel gas generated during the gasification. The fuel gas is taken out from the unit through line 26 on the heater; coke fines are removed from the fuel gas in heater cyclone system 27 comprising serially connected primary and secondary cyclones with diplegs which return the separated fines to the fluid bed in the heater. The fuel gas from line 26 can then undergo further processing. For example, in some aspects, the fuel gas from line 26 can be passed into a separation stage for separation of $CO_2$ (and/or $H_2S$). This can result in a stream with an increased concentration of synthesis gas, which can then be passed into a conversion stage for conversion of synthesis gas to methanol.

It is noted that in some optional aspects, heater cyclone system 27 can be located in a separate vessel (not shown) rather than in heater 11. In such aspects, line 26 can withdraw the fuel gas from the separate vessel, and the line 23 for purging excess coke can correspond to a line transporting coke fines away from the separate vessel. These coke fines and/or other partially gasified coke particles that are vented from the heater (or the gasifier) can have an increased content of metals relative to the feedstock. For example, the weight percentage of metals in the coke particles vented from the system (relative to the weight of the vented particles) can be greater than the weight percent of metals in the feedstock (relative to the weight of the feedstock). In other words, the metals from the feedstock are concentrated in the vented coke particles. Since the gasifier conditions do not create slag, the vented coke particles correspond to the mechanism for removal of metals from the coker/gasifier environment. In some aspects, the metals can correspond to a combination of nickel, vanadium, and/or iron. Additionally or alternately, the gasifier conditions can cause substantially no deposition of metal oxides on the interior walls of the gasifier, such as deposition of less than 0.1 wt % of the metals present in the feedstock introduced into the coker/gasifier system, or less than 0.01 wt %.

In configurations such as FIG. 1, the system elements shown in the figure can be characterized based on fluid communication between the elements. For example, reactor section 10 is in direct fluid communication with heater 11. Reactor section 10 is also in indirect fluid communication with gasifier 12 via heater 11.

As an alternative, integration of a fluidized bed coker with a gasifier can also be accomplished without the use of an intermediate heater. In such alternative aspects, the cold coke from the reactor can be transferred directly to the gasifier. This transfer, in almost all cases, will be unequivocally direct with one end of the tubular transfer line connected to the coke outlet of the reactor and its other end connected to the coke inlet of the gasifier with no intervening reaction vessel, i.e. heater. The presence of devices other than the heater is not however to be excluded, e.g. inlets for lift gas etc. Similarly, while the hot, partly gasified coke particles from the gasifier are returned directly from the gasifier to the reactor this signifies only that there is to be no intervening heater as in the conventional three-vessel Flexicoker™ but that other devices may be present between the gasifier and the reactor, e.g. gas lift inlets and outlets.

FIG. 2 shows an example of integration of a fluidized bed coker with a gasifier but without a separate heater vessel. In the configuration shown in FIG. 2, the cyclones for separating fuel gas from catalyst fines are located in a separate vessel. In other aspects, the cyclones can be included in gasifier vessel 41.

In the configuration shown in FIG. 2, the configuration includes a reactor 40, a main gasifier vessel 41 and a separator 42. The heavy oil feed is introduced into reactor 40 through line 43 and fluidizing/stripping gas through line 44; cracked hydrocarbon products are taken out through line 45. Cold, stripped coke is routed directly from reactor 40 to gasifier 41 by way of line 46 and hot coke returned to the reactor in line 47. Steam and oxygen are supplied through line 48. The flow of gas containing coke fines is routed to separator vessel 42 through line 49 which is connected to a gas outlet of the main gasifier vessel 41. The fines are separated from the gas flow in cyclone system 50 comprising serially connected primary and secondary cyclones with diplegs which return the separated fines to the separator vessel. The separated fines are then returned to the main gasifier vessel through return line 51 and the fuel gas product taken out by way of line 52. Coke is purged from the separator through line 53. The fuel gas from line 52 can then undergo further processing for separation of $CO_2$ (and/or $H_2S$) and conversion of synthesis gas to methanol.

The coker and gasifier can be operated according to the parameters necessary for the required coking processes. Thus, the heavy oil feed will typically be a heavy (high boiling) reduced petroleum crude; petroleum atmospheric distillation bottoms; petroleum vacuum distillation bottoms, or residuum; pitch; asphalt; bitumen; other heavy hydrocarbon residues; tar sand oil; shale oil; or even a coal slurry or coal liquefaction product such as coal liquefaction bottoms. Such feeds will typically have a Conradson Carbon Residue (ASTM D189-165) of at least 5 wt %, generally from 5 to 50 wt %. Preferably, the feed is a petroleum vacuum residuum.

Fluidized coking is carried out in a unit with a large reactor containing hot coke particles which are maintained in the fluidized condition at the required reaction temperature with steam injected at the bottom of the vessel with the average direction of movement of the coke particles being downwards through the bed. The heavy oil feed is heated to a pumpable temperature, typically in the range of 350° C. to 400° C. (~660° F. to 750° F.), mixed with atomizing steam, and fed through multiple feed nozzles arranged at several successive levels in the reactor. Steam is injected into a stripping section at the bottom of the reactor and passes upwards through the coke particles descending through the dense phase of the fluid bed in the main part of the reactor above the stripping section. Part of the feed liquid coats the coke particles in the fluidized bed and is subsequently cracked into layers of solid coke and lighter products which evolve as gas or vaporized liquid. The residence time of the feed in the coking zone (where temperatures are suitable for thermal cracking) is on the order of 1 to 30 seconds. Reactor pressure is relatively low in order to favor vaporization of the hydrocarbon vapors which pass upwards from dense phase into dilute phase of the fluid bed in the coking zone and into cyclones at the top of the coking zone where most of the entrained solids are separated from the gas phase by centrifugal force in one or more cyclones and returned to the dense fluidized bed by gravity through the cyclone diplegs. The mixture of steam and hydrocarbon vapors from the reactor is subsequently discharged from the cyclone gas outlets into a scrubber section in a plenum located above the coking zone and separated from it by a partition. It is quenched in the scrubber section by contact with liquid descending over sheds. A pump-around loop circulates condensed liquid to an external cooler and back to the top shed row of the scrubber section to provide cooling for the quench and condensation of the heaviest fraction of the liquid product. This heavy fraction is typically recycled to extinction by feeding back to the coking zone in the reactor.

During a fluidized coking process, the heavy oil feed, pre-heated to a temperature at which it is flowable and pumpable, is introduced into the coking reactor towards the top of the reactor vessel through injection nozzles which are constructed to produce a spray of the feed into the bed of fluidized coke particles in the vessel. Temperatures in the coking zone of the reactor are typically in the range of 450° C. to 650° C. and pressures are kept at a relatively low level, typically in the range of 0 kPag to 700 kPag (~0 psig to 100 psig), and most usually from 35 kPag to 320 kPag (~5 psig to 45 psig), in order to facilitate fast drying of the coke particles, preventing the formation of sticky, adherent high molecular weight hydrocarbon deposits on the particles which could lead to reactor fouling. In some aspects, the temperature in the coking zone can be 450° C. to 600° C., or 450° C. to 550° C. The conditions can be selected so that a desired amount of conversion of the feedstock occurs in the fluidized bed reactor. For example, the conditions can be selected to achieve at least 10 wt % conversion relative to 343° C. (or 371° C.), or at least 20 wt % conversion relative 343° C. (or 371° C.), or at least 40 wt % conversion relative to 343° C. (or 371° C.), such as up to 80 wt % conversion or possibly still higher. The light hydrocarbon products of the coking (thermal cracking) reactions vaporize, mix with the fluidizing steam and pass upwardly through the dense phase of the fluidized bed into a dilute phase zone above the dense fluidized bed of coke particles. This mixture of vaporized hydrocarbon products formed in the coking reactions flows upwardly through the dilute phase with the steam at superficial velocities of roughly 1 to 2 meters per second (~3 to 6 feet per second), entraining some fine solid particles of coke which are separated from the cracking vapors in the reactor cyclones as described above. In aspects where steam is used as the fluidizing agent, the weight of steam introduced into the reactor can be selected relative to the weight of feedstock introduced into the reactor. For example, the mass flow rate of steam into the reactor can correspond to 6.0% of the mass flow rate of feedstock, or 8.0% or more, such as up to 10% or possibly still higher. The amount of steam can potentially be reduced if an activated light hydrocarbon stream is used as part of the stripping and/or fluidizing gas in the reactor. In such aspects, the mass flow rate of steam can correspond to 6.0% of the mass flow rate of feedstock or less, or 5.0% or less, or 4.0% or less, or 3.0% or less. Optionally, in some aspects, the mass flow rate of steam can be still lower, such as corresponding to 1.0% of the mass flow rate of feedstock or less, or 0.8% or less, or 0.6% or less, such as down to substantially all of the steam being replaced by the activated light hydrocarbon stream.

The cracked hydrocarbon vapors pass out of the cyclones into the scrubbing section of the reactor and then to product fractionation and recovery.

In a general fluidized coking process, the coke particles formed in the coking zone pass downwards in the reactor and leave the bottom of the reactor vessel through a stripper section where they are exposed to steam in order to remove occluded hydrocarbons. The solid coke from the reactor, consisting mainly of carbon with lesser amounts of hydrogen, sulfur, nitrogen, and traces of vanadium, nickel, iron, and other elements derived from the feed, passes through the stripper and out of the reactor vessel to a burner or heater where it is partly burned in a fluidized bed with air to raise its temperature from 480° C. to 700° C. (~900° F. to 1,300° F.) to supply the heat required for the endothermic coking reactions, after which a portion of the hot coke particles is recirculated to the fluidized bed reaction zone to transfer the heat to the reactor and to act as nuclei for the coke formation. The balance is withdrawn as coke product. The net coke yield is only about 65 percent of that produced by delayed coking.

For a coking process that includes a gasification zone, the cracking process proceeds in the reactor, the coke particles pass downwardly through the coking zone, through the stripping zone, where occluded hydrocarbons are stripped off by the ascending current of fluidizing gas (steam). They then exit the coking reactor and pass to the gasification reactor (gasifier) which contains a fluidized bed of solid particles and which operates at a temperature higher than that of the reactor coking zone. In the gasifier, the coke particles are converted by reaction at the elevated temperature with steam and an oxygen-containing gas into a fuel gas comprising carbon monoxide and hydrogen.

The gasification zone is typically maintained at a high temperature ranging from 850° C. to 1,000° C. (~1,560° F. to 1,830° F.) and a pressure ranging from 0 kPag to 1000 kPag (~0 psig to 150 psig), preferably from 200 kPag to 400 kPag (~30 psig to 60 psig). Steam and an oxygen-containing gas are introduced to provide fluidization and an oxygen source for gasification. In some aspects the oxygen-containing gas can be air. In other aspects, the oxygen-containing gas can have a low nitrogen content, such as oxygen from an air separation unit or another oxygen stream including 95 vol % or more of oxygen, or 98 vol % or more, are passed into the gasifier for reaction with the solid particles comprising coke deposited on them in the coking zone. In aspects where the oxygen-containing gas has a low nitrogen content, a separate diluent stream, such as a recycled $CO_2$ or $H_2S$ stream derived from the fuel gas produced by the gasifier, can also be passed into the gasifier.

In the gasification zone the reaction between the coke and the steam and the oxygen-containing gas produces a hydrogen and carbon monoxide-containing fuel gas and a partially gasified residual coke product. Conditions in the gasifier are selected accordingly to generate these products. Steam and oxygen rates (as well as any optional $CO_2$ rates) will depend upon the rate at which cold coke enters from the reactor and to a lesser extent upon the composition of the coke which, in turn will vary according to the composition of the heavy oil feed and the severity of the cracking conditions in the reactor with these being selected according to the feed and the range of liquid products which is required. The fuel gas product from the gasifier may contain entrained coke solids and these are removed by cyclones or other separation techniques in the gasifier section of the unit; cyclones may be internal cyclones in the main gasifier vessel itself or external in a separate, smaller vessel as described below. The fuel gas product is taken out as overhead from the gasifier cyclones. The resulting partly gasified solids are removed from the gasifier and introduced directly into the coking zone of the coking reactor at a level in the dilute phase above the lower dense phase.

In some aspects, the coking conditions can be selected to provide a desired amount of conversion relative to 343° C. Typically a desired amount of conversion can correspond to 10 wt % or more, or 50 wt % or more, or 80 wt % or more, such as up to substantially complete conversion of the feedstock relative to 343° C.

The volatile products from the coke drum are conducted away from the process for further processing. For example, volatiles can be conducted to a coker fractionator for distillation and recovery of coker gases, coker naphtha, light gas oil, and heavy gas oil. Such fractions can be used, usually, but not always, following upgrading, in the blending of fuel and lubricating oil products such as motor gasoline, motor diesel oil, fuel oil, and lubricating oil. Upgrading can include separations, heteroatom removal via hydrotreating and non-hydrotreating processes, de-aromatization, solvent extraction, and the like. The process is compatible with processes where at least a portion of the heavy coker gas oil present in the product stream introduced into the coker fractionator is captured for recycle and combined with the fresh feed (coker feed component), thereby forming the coker heater or coker furnace charge. The combined feed ratio ("CFR") is the volumetric ratio of furnace charge (fresh feed plus recycle oil) to fresh feed to the continuous delayed coker operation. Delayed coking operations typically employ recycles of 5 vol % to 35% vol % (CFRs of about 1.05 to about 1.35). In some instances there can be no recycle and sometimes in special applications recycle can be up to 200%.

Coking Conditions—Delayed Coking

Delayed coking is a process for the thermal conversion of heavy oils such as petroleum residua (also referred to as "resid") to produce liquid and vapor hydrocarbon products and coke. Delayed coking of resids from heavy and/or sour (high sulfur) crude oils is carried out by converting part of the resids to more valuable hydrocarbon products. The resulting coke has value, depending on its grade, as a fuel (fuel grade coke), electrodes for aluminum manufacture (anode grade coke), etc.

Generally, a residue fraction, such as a petroleum residuum feed is pumped to a pre-heater where it is preheated, such as to a temperature from 480° C. to 520° C. The pre-heated feed is conducted to a coking zone, typically a vertically-oriented, insulated coker vessel, e.g., drum, through an inlet at the base of the drum. Pressure in the drum is usually relatively low, such as 15 psig (~100 kPa-g) to 80 psig (~550 kPa-g), or 15 psig (~100 kPa-g) to 35 psig (~240 kPa-g) to allow volatiles to be removed overhead. Typical operating temperatures of the drum will be between roughly 400° C. to 445° C., but can be as high as 475° C. The hot feed thermally cracks over a period of time (the "coking time") in the coke drum, liberating volatiles composed primarily of hydrocarbon products that continuously rise through the coke bed, which consists of channels, pores and pathways, and are collected overhead. The volatile products are conducted to a coker fractionator for distillation and recovery of coker gases, gasoline boiling range material such as coker naphtha, light gas oil, and heavy gas oil. In an embodiment, a portion of the heavy coker gas oil present in the product stream introduced into the coker fractionator can be captured for recycle and combined with the fresh feed (coker feed component), thereby forming the coker heater or coker furnace charge. In addition to the volatile products, the process also results in the accumulation of coke in the drum. When the coke drum is full of coke, the heated feed is switched to another drum and hydrocarbon vapors are purged from the coke drum with steam. The drum is then quenched with water to lower the temperature down to 200° F. (~95° C.) to 300° F. (~150° C.), after which the water is drained. When the draining step is complete, the drum is opened and the coke is removed by drilling and/or cutting using high velocity water jets ("hydraulic decoking").

Configuration Examples

Figure 3:
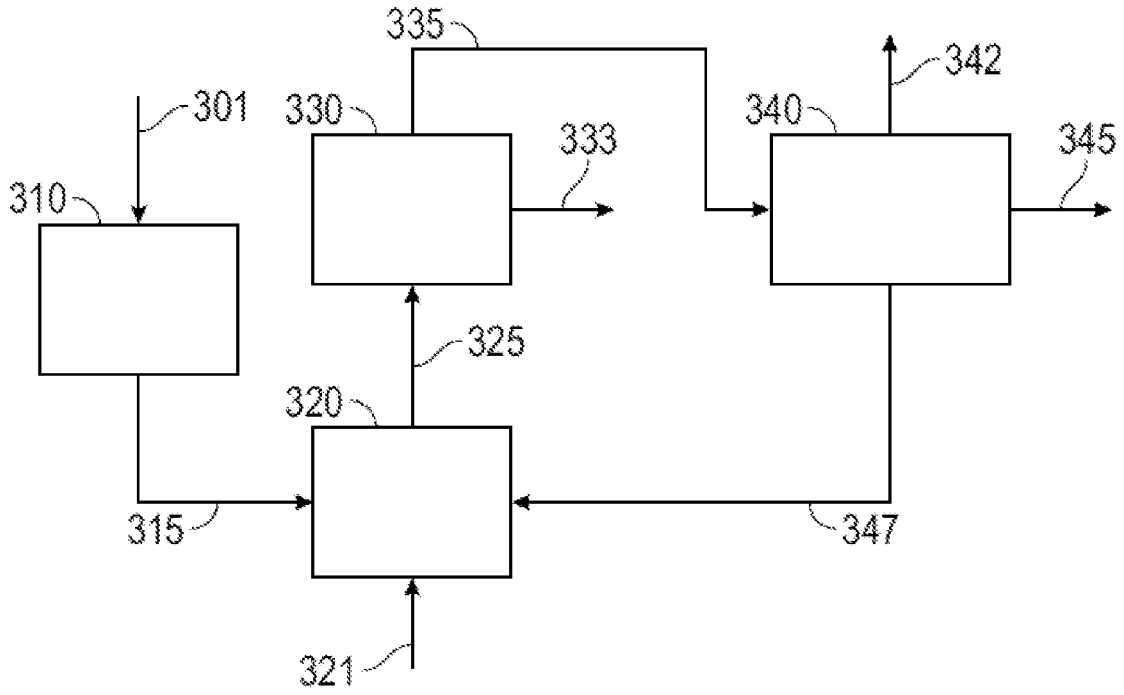
FIG. 3 shows an example of a system and process flow for co-processing of a plastic waste feedstock and a coker feedstock.

FIG. 3 shows an example of a configuration for co-processing of a plastic waste feedstock during fluidized coking. In FIG. 3, a solid plastic waste feedstock 301 is physically processed in a plastic feed preparation stage 310. Physically processing the feedstock can include one or more processes to reduce the particle the median particle size of the particles in the feed; to remove particles larger than a target particle size from the feedstock; to create particles of a desired size (such as by melting followed by pelletizing); and/or to convert the feedstock to a liquid by melting. The physically processed plastic waste feedstock 315 can then be combined with a coker feedstock 321 in mixing stage 320. Optionally, the plastic waste feedstock can also be combined with an optional solvent 347. Optionally, the combined feedstock 325 can be heated prior to exiting mixing stage 320. This optional heating can be in addition to any heating that is performed by a pre-heater as part of coker 330. Coker 330 can correspond to a fluidized coker or a delayed coker. Coker 330 can generate at least a solid coke product 333 and a fluid product 335. In aspects where coker 330 includes a gasifier, coker 330 can further generate a low BTU fuel gas (not shown) that includes synthesis gas components.

The fluid product 335 can be passed into a fractionation stage 340 that includes one or more types of fractionators and/or separators. Fractionation stage 340 can separate the fluid product into one or more gas phase products 342 and one or more liquid products 345. Optionally, an additional liquid product can be generated for use as solvent 347. For example, a diesel or gas oil boiling range product can be used as solvent 347. Alternatively, solvent 347 can correspond to a solvent from another source.

Examples of Coking Products

A commonly expected yield of coke from coking of a conventional coker feedstock is roughly 20 wt % to 40 wt % of the coker feedstock. Plastic waste feedstocks can have a substantially higher atomic ratio of hydrogen to carbon. As a result, plastic waste feedstocks can produce a reduced or minimized amount of coke in a coking environment. Additionally, many types of plastic waste have a relatively low sulfur content. This can provide an advantage by reducing the sulfur content of the coker products, thus reducing the needed severity for any subsequent sulfur removal processes (such as hydroprocessing).

Table 2 shows an example of total product slates from performing a laboratory scale coking process on neat polyethylene and neat polystyrene. Polyethylene is a representative polyolefin. Polyolefins and polystyrene are representative examples of polymers that are common in plastic waste.

TABLE 2

Coking Yields for Plastic Feedstocks (wt %)

| | Polyethylene | Polystyrene |
|---|---|---|
| $C_{4-}$ | 8.9 | 0.5 |
| $C_5$-204° C. (naphtha) | 22.4 | 51.7 |
| 204° C.-343° C. (distillate) | 35.7 | 20.4 |
| 343° C.+ (gas oil) | 33.3 | 18.5 |
| coke | ~0 | 8.8 |

As shown in Table 2, coking of neat polyethylene resulted in substantially no coke production, while also producing greater than 50 wt % yield of distillate and gas oil boiling range products. Coking of the neat polystyrene resulted in a different product slate, with more than 50 wt % of the product corresponding to naphtha boiling range components. Coking of the polystyrene also resulted in some coke production, with an amount corresponding to less than 10 wt % of the polystyrene feed.

It has been discovered that the reduced coke production observed for neat polymer feedstocks (representative of plastic waste) can be used to improve the yield of fluid products during co-processing of polymers with conventional coker feedstocks. Table 3 shows results from laboratory scale coking of a resid feedstock with a polymer feedstock. In Table 3, the first column shows processing of the resid coker feedstock alone, while the other columns correspond to coking of the resid feedstock with varying amounts of polymer. PE refers to polyethylene, which is provided as an example of a polyolefin polymer. PS refers to polystyrene.

TABLE 3

Co-Processing of Coker Feedstock and Polymer Feedstock

| | Resid only | Resid + PE | Resid + PE | Resid + PS |
|---|---|---|---|---|
| Wt % plastic | 0 | 6 | 12 | 6 |
| Liquid Yield (wt %) | 64.0 | 70.4 | 74.0 | 69.6 |
| Paraffins (wt % of liquid yield) | 24.4 | 26.8 | 30.5 | 21.0 |
| Naphthenes (wt % of liquid yield) | 45.5 | 45.9 | 44.8 | 41.2 |
| Aromatics (wt % of liquid yield) | 30.1 | 27.3 | 24.7 | 37.8 |
| 1-ring | 20.1 | 18.3 | 16.6 | 27.9 |
| 2-ring | 8.1 | 7.3 | 6.6 | 8.1 |
| 3-ring | 2.0 | 1.8 | 1.5 | 1.8 |

As shown in Table 3, addition of either polyethylene or polystyrene provides a substantial increase in liquid product yield. Surprisingly, for co-processing of the polyolefin polymer, the naphthene content of the resulting liquid is similar to the naphthene content for the resid feedstock alone. This is in contrast to using polystyrene as the co-feed, where substantially all of the increase in liquid yield corresponds to 1-ring aromatics.

Additional Embodiments

Embodiment 1. A method for performing fluidized coking on a combined feed, comprising: physically processing a plastic waste feedstock comprising one or more polymers to form a processed plastic waste feedstock comprising a median particle size of 5 mm or less; combining at least a portion of the processed plastic waste feedstock with a feedstock comprising a T10 distillation point of 343° C. or higher to form a combined feed comprising 1.0 wt % to 25 wt % of the plastic waste feedstock; and exposing at least a portion of the combined feed to fluidized coking conditions in a coking reactor to form a coker effluent.

Embodiment 2. The method of Embodiment 1, further comprising mixing the processed plastic waste feedstock with a solvent, the processed plastic waste feedstock optionally being mixed with the solvent prior to forming the combined feed.

Embodiment 3. The method of Embodiment 2, further comprising separating the coker effluent to form at least a naphtha boiling range fraction and a higher boiling fraction, the solvent comprising at least a portion of the higher boiling fraction.

Embodiment 4. The method of any of the above embodiments, wherein the at least a portion of the processed plastic waste feedstock is combined with the feedstock comprising a T10 distillation point of 343° C. or higher in one or more mixing vessels, the method further comprising i) heating the combined feed to a temperature of 200° C. or more in the one or more mixing vessels.

Embodiment 5. The method of any of the above embodiments, further comprising stripping the combined feed with a stripping gas, the stripping optionally being performed in the one or more mixing vessels.

Embodiment 6. The method of any of the above embodiments, wherein the fluidized coking conditions comprise exposing the combined feed to a fluidized bed of coke particles at a temperature of 450° C. to 650° C.

Embodiment 7. The method of Embodiment 6, wherein the method further comprises withdrawing a portion of the coke particles from the fluidized bed of coke particles; passing the withdrawn portion of coke particles into a gasifier; and gasifying the withdrawn portion of coke particles to form a fuel gas comprising $H_2$ and CO.

Embodiment 8. The method of any of the above embodiments, wherein the combined feed comprises 5.0 wt % to 15 wt % of the plastic waste feedstock.

Embodiment 9. The method of any of the above embodiments, wherein the plastic waste feedstock comprises 10 wt % or more polyolefin, or wherein the plastic waste feedstock comprises polyethylene.

Embodiment 10. The method of any of the above embodiments, wherein the physical processing comprises grinding, chopping, crushing, cryogenic grinding, melting, pelletizing, shredding, cryogenic grinding, or a combination thereof, the physical processing optionally further comprising sieving the processed plastic waste feedstock.

Embodiment 11. The method of any of the above embodiments, wherein the processed plastic waste feedstock comprises a maximum particle size of 10 mm or less.

Embodiment 12. A system for performing fluidized coking, comprising: a physical processing stage for forming a processed plastic waste feedstock; a mixing stage in fluid communication with the physical processing stage and further in fluid communication with a source of a second feedstock, the mixing stage further comprising a heater; and a fluidized coking stage in fluid communication with the mixing stage, the fluidized coking stage comprising a reactor and a gasifier.

Embodiment 13. The system of Embodiment 12, wherein the mixing stage is further in fluid communication with a source of a solvent, or wherein the mixing stage is further in fluid communication with a source of a stripping gas, or a combination thereof.

Embodiment 14. The system of Embodiment 12 or 13, wherein the physical processing stage comprises grinding, chopping, crushing, cryogenic grinding, melting, pelletizing, shredding, cryogenic grinding, or a combination thereof.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for performing coking on a combined feed, comprising:

physically processing a plastic waste feedstock without melting of the plastic waste feedstock to produce a processed plastic waste feedstock comprising a median particle size of 5 mm or less, wherein the plastic waste feedstock comprises one or more polymers;

filtering the processed plastic waste feedstock to remove larger particles and produce a filtered plastic waste feedstock comprising a maximum particle size of 10 mm or less;

pre-heating at least a portion of the filtered plastic waste feedstock and a coker feedstock to produce a pre-heated plastic waste feedstock and a pre-heated coker feedstock;

combining at least a portion of the pre-heated plastic waste feedstock with the pre-heated coker feedstock in one or more mixing vessels to form a combined feed, wherein the coker feedstock comprises a T10 distillation point of 343° C. or higher and the combined feed comprises 1.0 wt % to 25 wt % of the pre-heated plastic waste feedstock;

heating the combined feed to a temperature of 200° C. to 325° C. in the one or more mixing vessels;

stripping the combined feed with a stripping gas in the one or more mixing vessels to remove gases including hydrogen chloride gas that evolve in the one or more mixing vessels; and coking at least a portion of the combined feed under coking conditions in a coking reactor to form a coker effluent.

2. The method of claim 1, further comprising mixing the filtered plastic waste feedstock with a solvent.

3. The method of claim 2, wherein the filtered plastic waste feedstock is mixed with the solvent prior to forming the combined feed.

4. The method of claim 2, further comprising separating the coker effluent to form at least a naphtha boiling range fraction and a higher boiling fraction, the solvent comprising at least a portion of the higher boiling fraction.

5. The method of claim 1, wherein the coking conditions comprise exposing the combined feed to a fluidized bed of coke particles at a temperature of 450° C. to 650° C.

6. The method of claim 5, further comprising:

withdrawing a portion of the coke particles from the fluidized bed of coke particles;

passing the withdrawn portion of coke particles into a gasifier; and gasifying the withdrawn portion of coke particles to form a fuel gas comprising $H_2$ and CO.

7. The method of claim 1, wherein the combined feed comprises 5.0 wt % to 15 wt % of the pre-heated plastic waste feedstock.

8. The method of claim 1, wherein the plastic waste feedstock comprises 10 wt % or more polyolefin.

9. The method of claim 1, wherein the plastic waste feedstock comprises polyethylene.

10. The method of claim 1, wherein the physical processing comprises grinding, chopping, crushing, cryogenic grinding, shredding, or a combination thereof.

11. The method of claim 1, wherein the processed plastic waste feedstock comprises a maximum particle size of 5 mm or less.

12. The method of claim 1, wherein the at least a portion of the combined feed is exposed to fluidized coking conditions in the coking reactor.

* * * * *